US007827688B2

(12) United States Patent
Chen

(10) Patent No.: US 7,827,688 B2
(45) Date of Patent: Nov. 9, 2010

(54) METHOD FOR RIVETING FINS INTO BOTTOM PLATE OF HEAT DISSIPATING DEVICE

(76) Inventor: Shyh-Ming Chen, 235 Chung-Ho, Box 8-24, Taipei (TW)

( * ) Notice: Subject to any disclaimer, the term of this patent is extended or adjusted under 35 U.S.C. 154(b) by 1239 days.

(21) Appl. No.: 11/406,128

(22) Filed: Apr. 19, 2006

(65) Prior Publication Data

US 2006/0260128 A1 Nov. 23, 2006

(30) Foreign Application Priority Data

May 20, 2005 (TW) ..... 94116481 A

(51) Int. Cl.
*B21D 53/02* (2006.01)
*B23P 11/00* (2006.01)
*F28E 3/02* (2006.01)

(52) U.S. Cl. ..... 29/890.03; 29/890.039; 29/505; 29/509; 165/80.3; 165/185

(58) Field of Classification Search . 29/890.03–890.07, 29/505, 509; 165/80.3, 185
See application file for complete search history.

(56) References Cited

U.S. PATENT DOCUMENTS

| | | | | |
|---|---|---|---|---|
| 6,758,262 | B2 * | 7/2004 | Kawabata et al. | 165/80.3 |
| 6,851,186 | B2 * | 2/2005 | Liang | 29/890.03 |
| 7,497,013 | B2 * | 3/2009 | Zaghlol | 29/890.03 |
| 2005/0150633 | A1 * | 7/2005 | Lee et al. | 165/80.3 |

* cited by examiner

*Primary Examiner*—David P Bryant
*Assistant Examiner*—Sarang Afzali

(57) ABSTRACT

A method for riveting fins into a bottom plate of a heat dissipating device is disclosed. A punching device has a plurality of weights each of which is formed as a thin sheet. The punching device is installed to a fixture; a plurality of fins are spaced with a predetermined gap; and a bottom plate is formed with a plurality of trenches for receiving the fins. The method comprising the step of: positioning the bottom plate at the fixture; inserting the fins into the trenches of the bottom plate; inserting the weights of the punching device into the fins so that each space between two fins has a weight; and punching a backside of the bottom plate by a puncher so that as the bottom plate moves; the weights collide with and deform portions of the bottom plate between the fins to rivet the fins into the bottom plate, firmly securing the fins in the bottom plate.

5 Claims, 7 Drawing Sheets

METHOD FOR RIVETING FINS INTO BOTTOM PLATE OF HEAT DISSIPATING DEVICE

FIELD OF THE INVENTION

The present invention relates to heat dissipation, and in particular to a method for riveting fins into a bottom plate of a heat dissipating device. The present invention can be used for high-level electronic device or IC circuits. Further more fins can be embedded in a seat so as to increase the heat dissipating area. Moreover in the process of the present invention, the punching force is uniformly distributed on the seat so that the fins can be densely arranged to provide high efficiency heat dissipation function.

BACKGROUND OF THE INVENTION

In the current integrated circuit (IC) or electronic devices, the heat dissipating device has a bottom plate and a heat dissipating unit. The bottom plate has a plurality of trenches. Fins are inserted into the trenches. The method for fixing the fins to the bottom plate can be referred to FIG. 1. The bottom plate 10 of the heat dissipating device 1 is formed with trenches 11. The bottom plate 10 is fixed to the fixture (not shown). Then they are fixed below a punching device 12. The punching device 12 has a plurality of weights 13. The weights 13 are driven by a puncher to move upwards and downwards. The weights 13 pass through the gaps between the fins 14 to collide a surface of the bottom plate 10 so that the fins 14 are riveted into the bottom plate 10. Thus a heat dissipating device 1 is formed.

With the progress of the chip and IC technologies, more and more heats are generated and are concentrated in some predetermined parts of the devices and the increment of temperature is more and more rapid. To have high heat dissipating ability, the material of the heat dissipating device 1 is improved, such as using copper to replace aluminum. Further, more fins 14 are planted in the bottom plate 10 so as to increase the heat dissipating area. As a result, the density of the fins 14 on the bottom plate 10 is increased. To cause the weights 13 can be inserted into the gaps between the fins 14 and thus they can punch the bottom plate 10. However this will break the bottom plate 10. Moreover, the fins 14 have errors so that the weights 13 cannot be accurately aligned to the gaps between fins 14. As a result, in the punching process, it is possible that the fins 14 will be destroyed and thus the yield ratio is low. Thereby the weights 13 are possibly destroyed in the punching process. However the weights 13 are expensive.

SUMMARY OF THE INVENTION

Accordingly, the primary object of the present invention is to provide a method for riveting fins into a bottom plate of a heat dissipating device. The present invention can be used for high level electronic device or IC circuits. Further more fins can be embedded in a seat so as to increase the heat dissipating area. Moreover in the process of the present invention, the punching force is uniformly distributed on the seat so that the fins can be densely arranged to provide a high efficiency heat dissipation function.

To achieve above objects, the present invention provides a method for riveting fins into a bottom plate of a heat dissipating device. A punching device has a plurality of weights each of which is formed as a thin sheet. The punching device is installed to a fixture; a plurality of fins are spaced with a predetermined gap; and a bottom plate is formed with a plurality of trenches for receiving the fins. The method comprising the step of: positioning the bottom plate at the fixture; inserting the fins into the trenches of the bottom plate; inserting the weights of the punching device into the fins so that a space between two fins has a weight; and punching a backside of the bottom plate by a puncher so that the bottom plate moves; the weights colliding portions of the bottom plate between the fins so as to deform and rivet the fins into the bottom plate; and thus the fins are firmly secured in the bottom plate.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
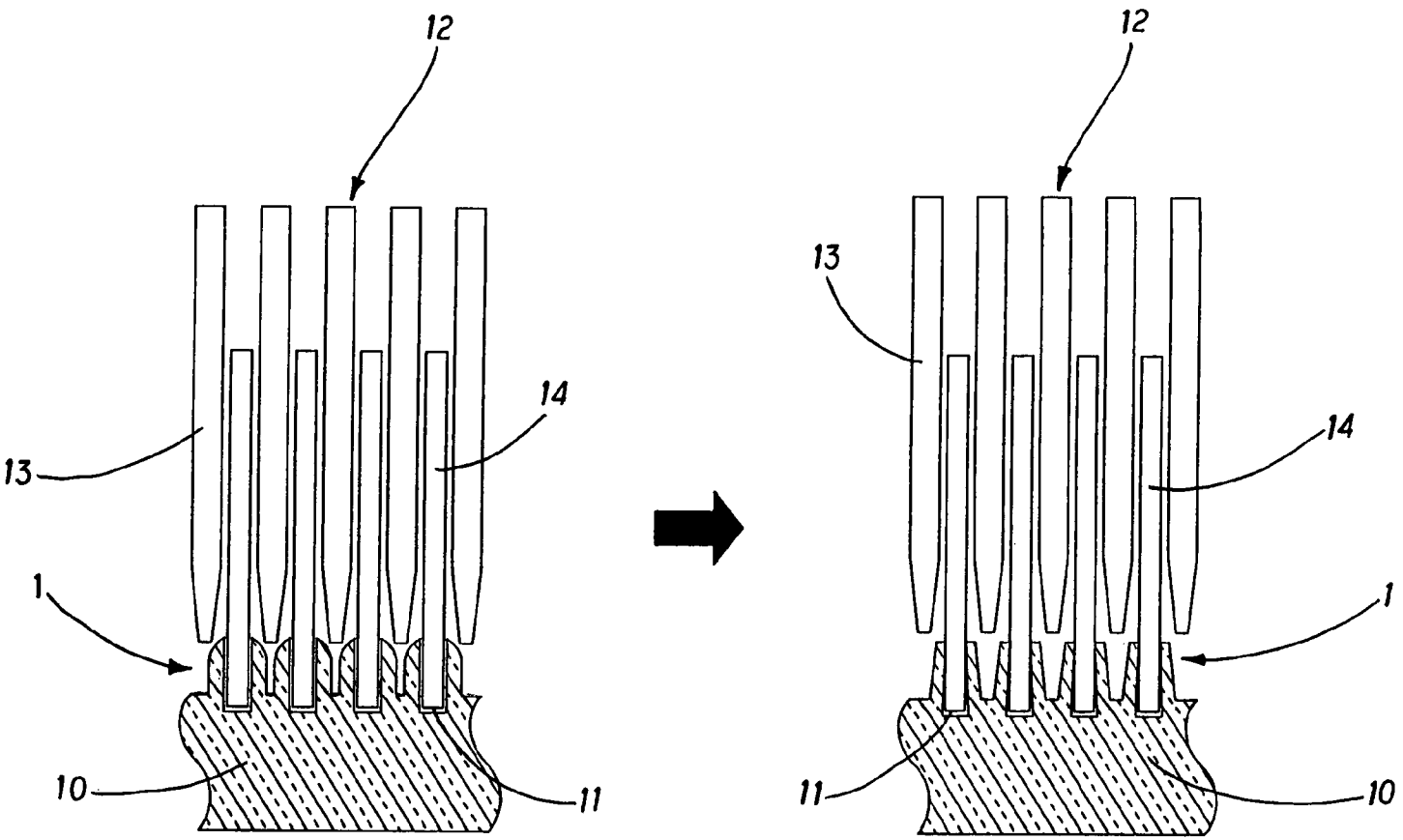
FIG. 1 shows a prior art punching process of a heat dissipating device.
Figure 2:
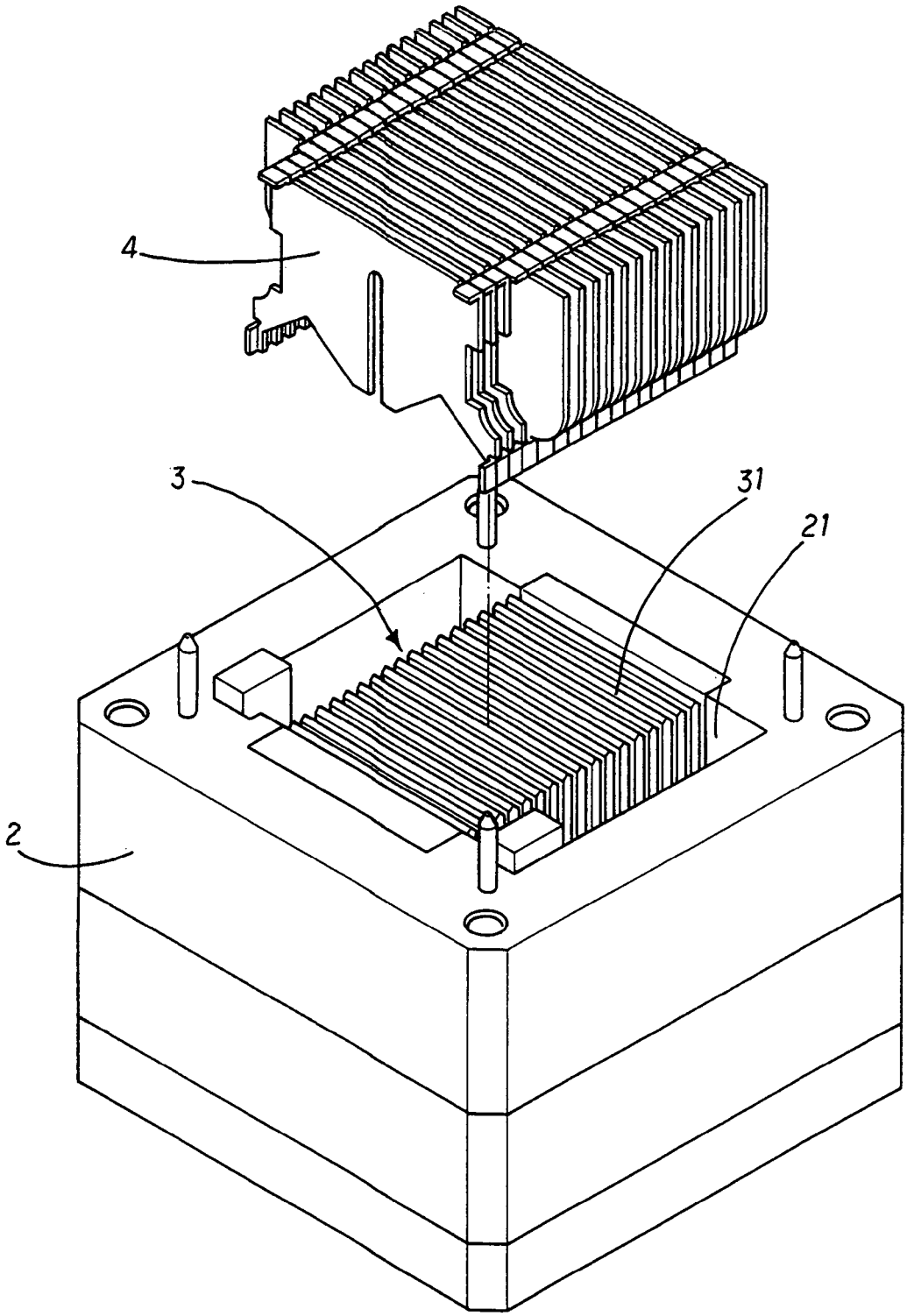
FIG. 2 is a perspective view showing that the weights are fixed to a fixture.
Figure 3:
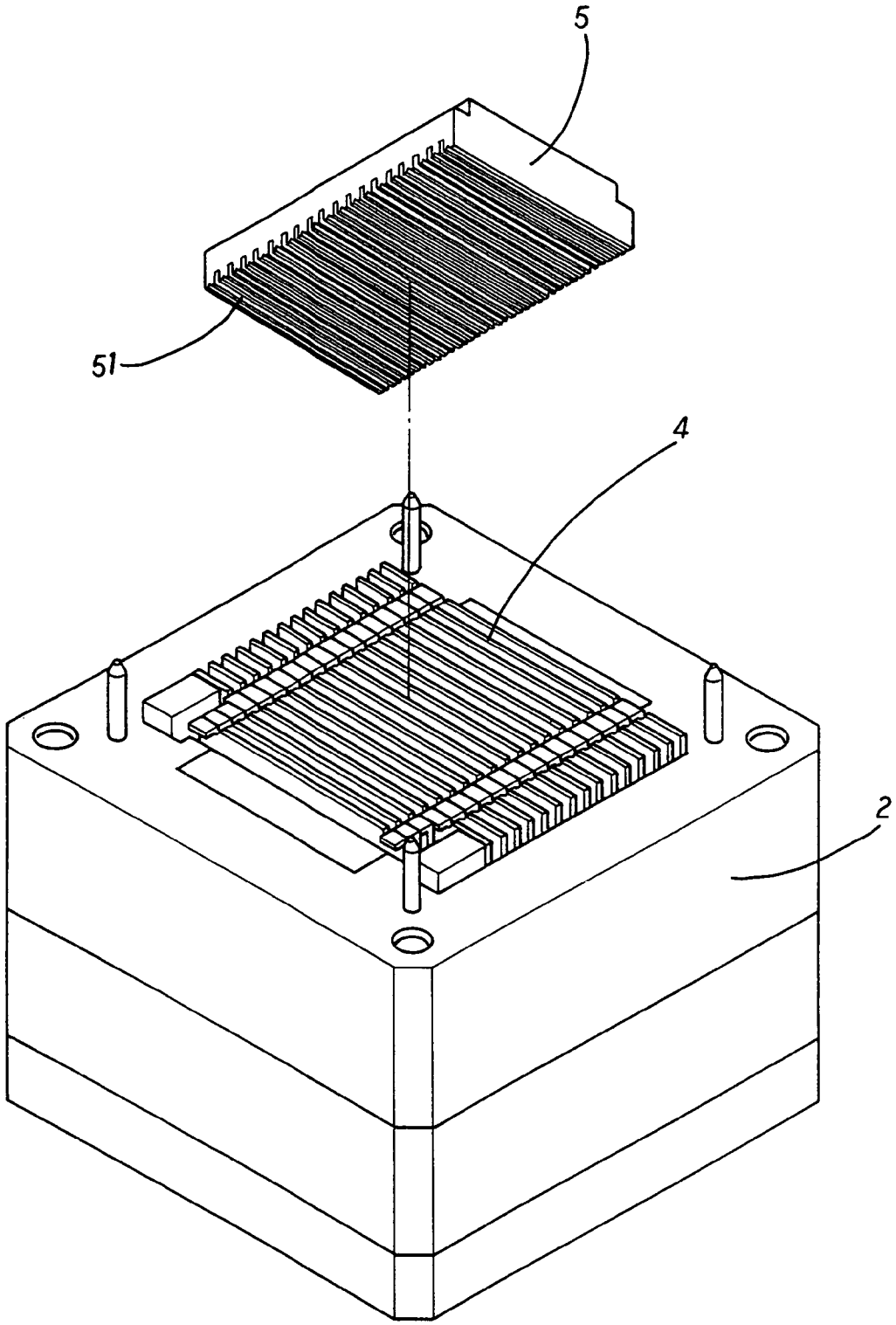
FIG. 3 is a perspective view showing that the fins and weights are fixed to a fixture.

With reference to FIGS. 2 and 3, the present invention has the following elements.

A fixture 2 has a recess 21.

A punching device 3 has a plurality of weights 31 each of which is formed as a thin sheet. The punching device 3 is installed in the recess 21 of the fixture 2.

A plurality of fins 4 are spaced with a predetermined gap.

A bottom plate 5 is formed with a plurality of trenches 51 for receiving the fins 4.

Figure 4:
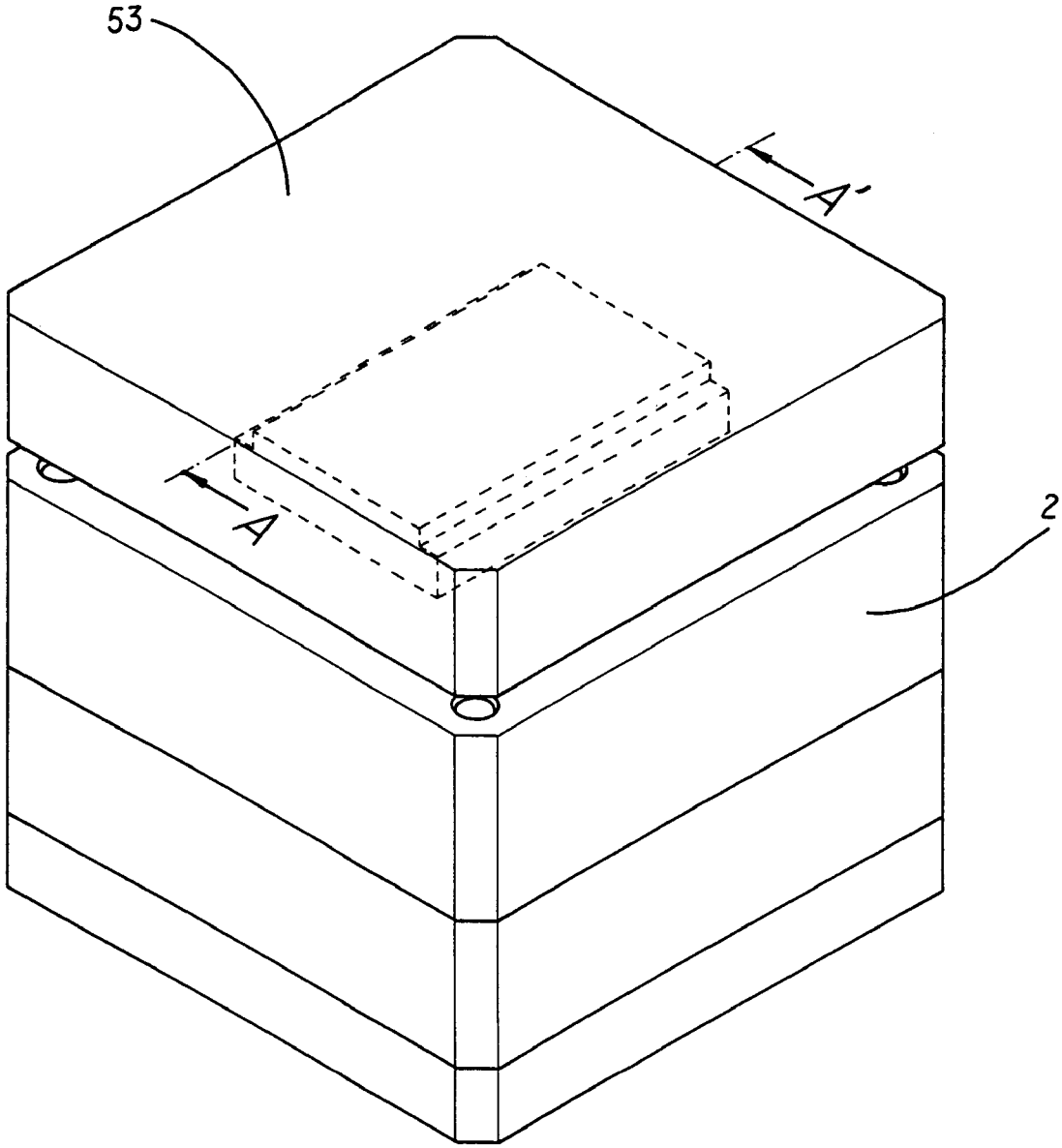
FIG. 4 is a perspective view showing the assembly of the bottom plate with trenches, fins and fixture.

In the manufacturing process, the bottom plate 5 is positioned at the fixture 2. The fins 4 are inserted into the trenches 51 of the bottom plate 5. The weights 31 of the punching device 3 are inserted into the fins 4 so that each space between two fins 4 has a weight 31 (referring to FIG. 4). A puncher (not shown) punches a backside of the bottom plate 5 so that the bottom plate 5 moves. The weights 31 collide portions of the bottom plate 5 between the fins 4 so as to deform (referring to FIGS. 5 and 6) and thus to rivet the fins 4 into the bottom plate 5 and thus the fins 4 are firmly secured in the bottom plate 5. As a result, a heat dissipating device is formed, as shown in FIG. 7.

Figure 5:
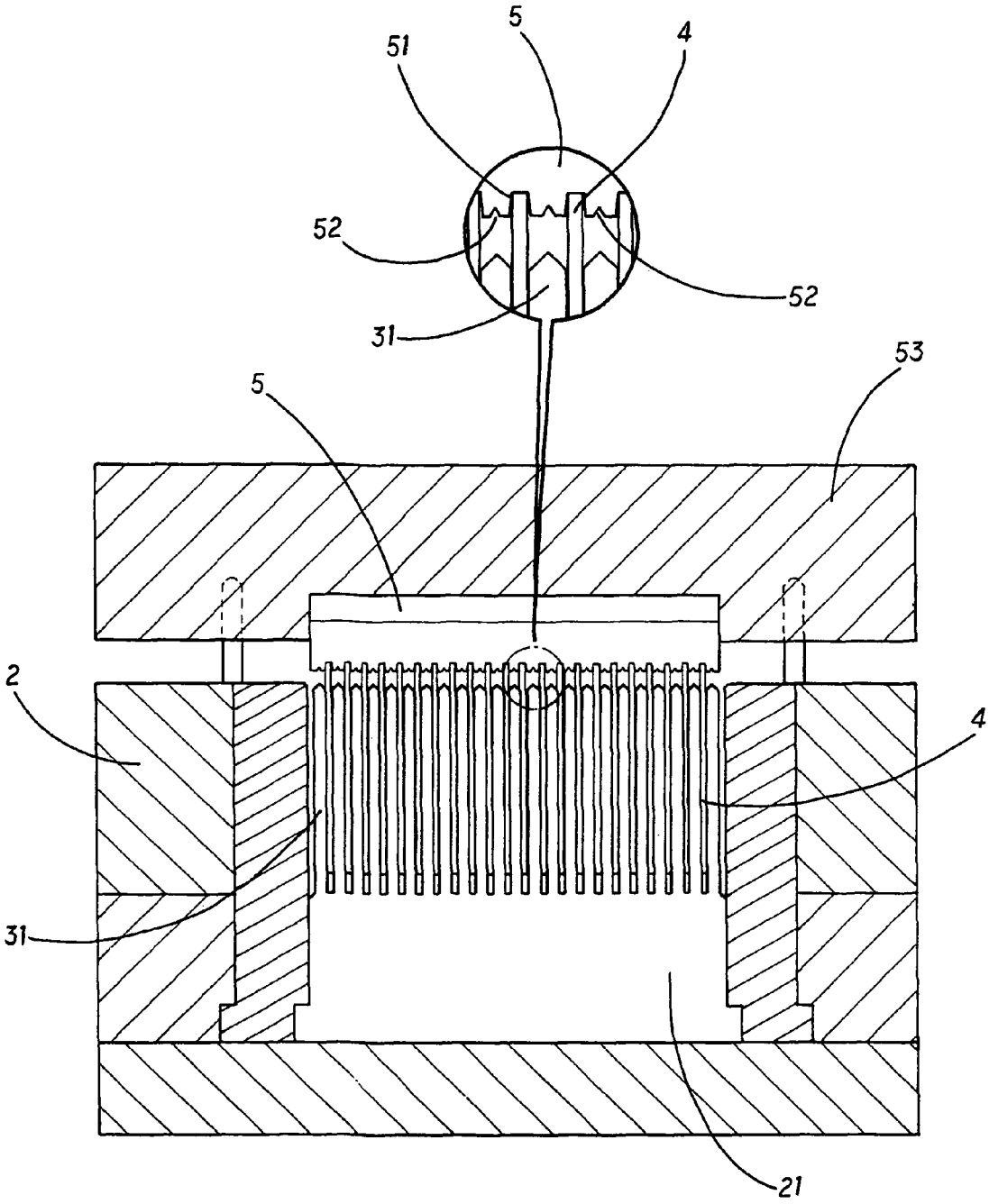
FIG. 5 is a cross sectional view along line A-A of FIG. 4.
Figure 6:
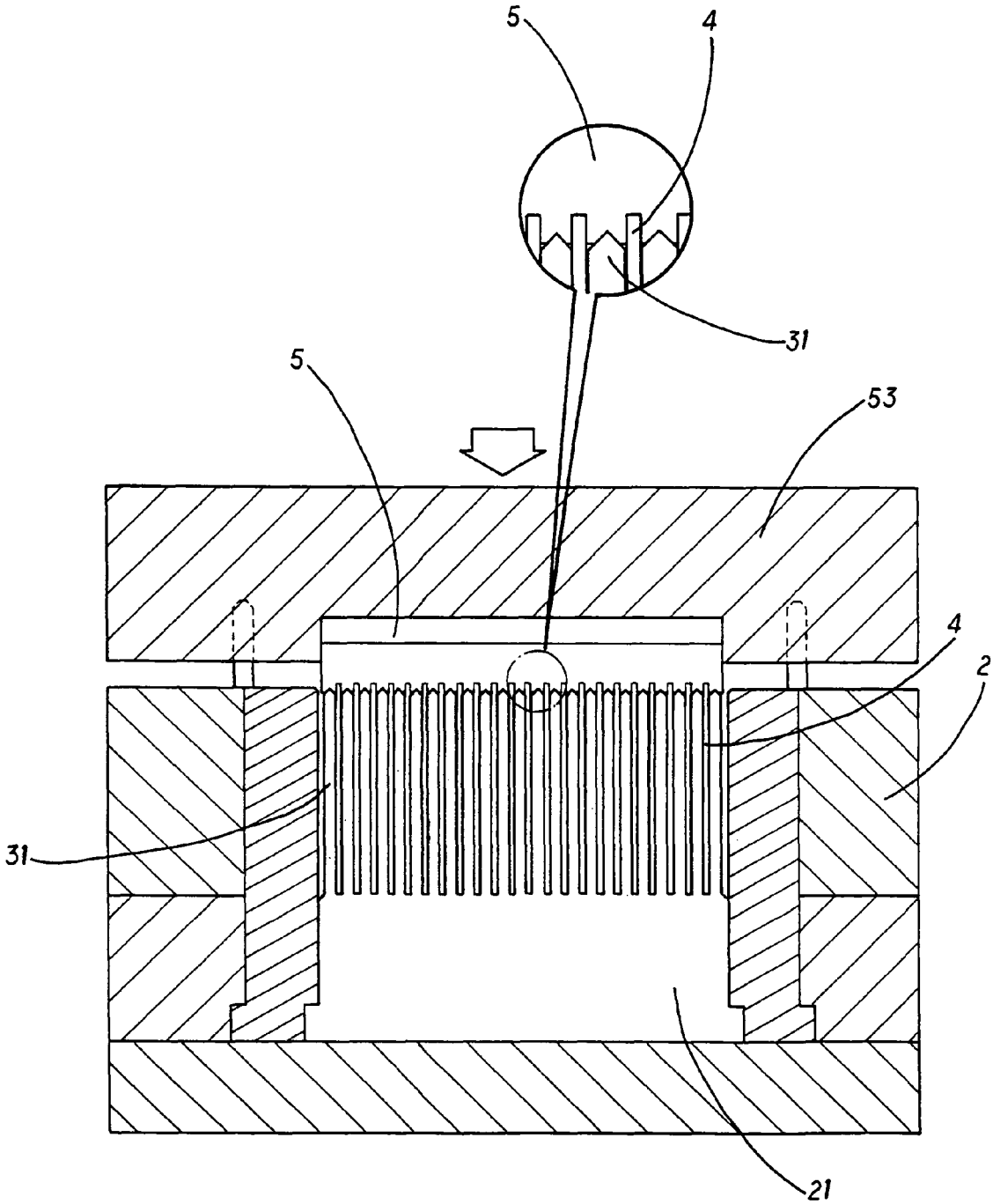
FIG. 6 shows the operation of punching according to the present invention, wherein the weights collide the gaps between the fins so that a surface of the bottom plate deforms.
Figure 7:
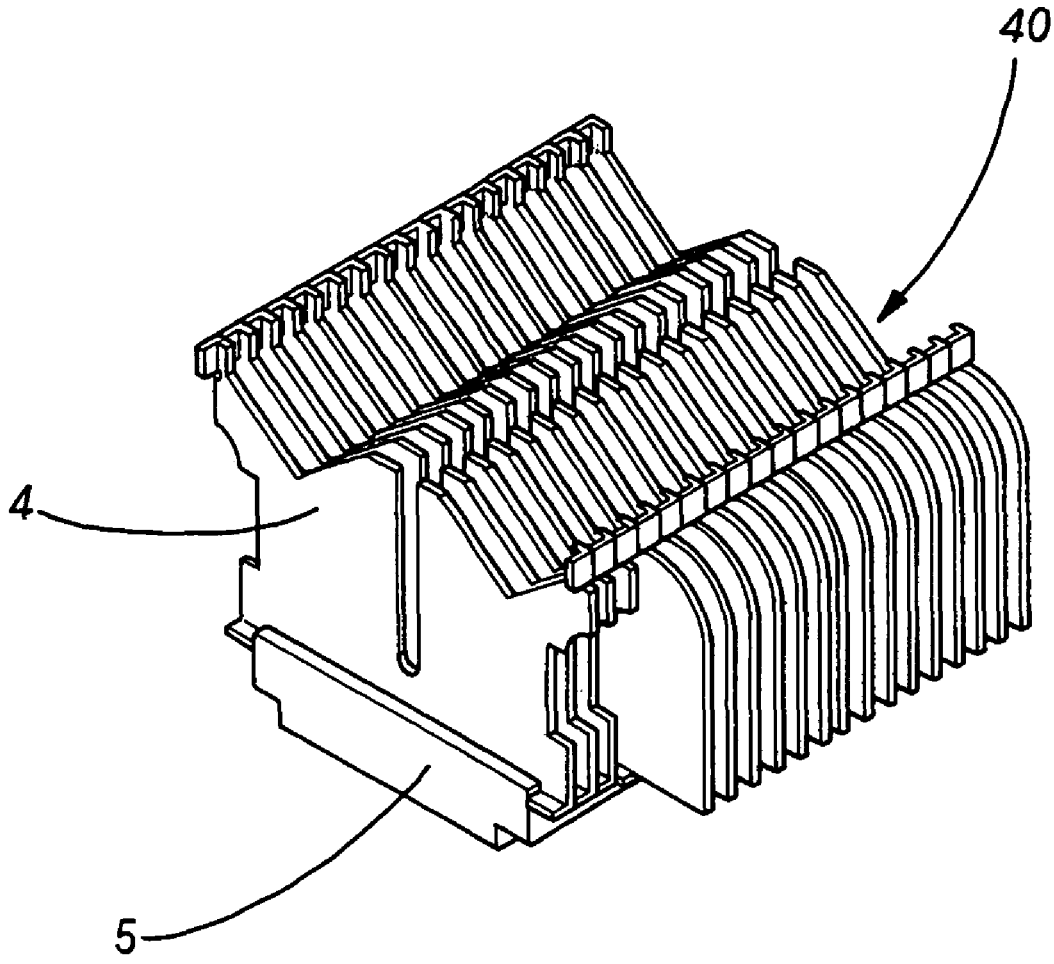
FIG. 7 is a perspective view of a heat dissipating device according to the process of FIG. 6.

To make the weights 31 collide the bottom plate 5 conveniently with less force, in the present invention, a guide groove 52 is formed between two adjacent trenches 51 (referring to FIGS. 5 and 6). In the punching process, the weight 31 punches the guide groove 52.

Moreover, the backside of the bottom plate 5 is fixed with a positioning block 53. In the punching process, the puncher punches the positioning block 53. Thus, the force can be uniformly distributed on the bottom plate 5 so that the fins 4 are firmly secured in the bottom plate 5.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for riveting fins into a bottom plate of a heat dissipating device comprising a punching device having a plurality of weights, each of which is formed as a thin sheet, the punching device is installed to a fixture, a plurality of fins are spaced with a predetermined gap, and a bottom plate is formed with a plurality of trenches for receiving the fins, the method comprising the steps of:

positioning the bottom plate at the fixture;

inserting the fins into the trenches of the bottom plate;

inserting the weights of the punching device into the fins so that each space between two fins has a weight; and punching a backside of the bottom plate by a puncher so that as the bottom plate moves, the weights collide with and deform portions of the bottom plate between the fins so as to rivet the fins into the bottom plate, firmly securing the fins in the bottom plate.

2. The method of claim 1, wherein the fins are formed as an integral body and gaps are formed between fins.

3. The method of claim 1, wherein the weights punch a guide groove formed between two adjacent trenches.

4. The method of claim 1, wherein a backside of the bottom plate is fixed with a positioning block, the puncher punches the positioning block as the force is uniformly distributed on the bottom plate so that the fins are firmly secured in the bottom plate.

5. The method of claim 1, wherein the fixture has a recess and the punching device is installed in the recess of the fixture.

* * * * *